US010975512B2

(12) United States Patent
Smith

(10) Patent No.: US 10,975,512 B2
(45) Date of Patent: Apr. 13, 2021

(54) WASHING MACHINE APPLIANCE AND METHODS FOR PREVENTING SPIN OUT-OF-BALANCE CONDITIONS

(71) Applicant: Haier US Appliance Solutions, Inc., Wilmington, DE (US)

(72) Inventor: Darrin R. Smith, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 211 days.

(21) Appl. No.: 16/152,489

(22) Filed: Oct. 5, 2018

(65) Prior Publication Data

US 2020/0109505 A1 Apr. 9, 2020

(51) Int. Cl.
*D06F 33/76* (2020.01)
*D06F 37/20* (2006.01)
(Continued)

(52) U.S. Cl.
CPC ..... *D06F 37/203* (2013.01); *D06F 35/007* (2013.01); *D06F 37/245* (2013.01);
(Continued)

(58) Field of Classification Search
CPC ..... D06F 18/00; D06F 33/00; D06F 33/30; D06F 33/40; D06F 33/44; D06F 33/48; D06F 33/50–76; D06F 34/00; D06F 34/04–34; D06F 35/007; D06F 37/40; D06F 37/203; D06F 37/22; D06F 37/225; D06F 37/24; D06F 37/245; D06F 39/00; D06F 58/00; D06F 58/02; D06F 58/203; D06F 58/30; D06F 2101/00–20; D06F 2103/00–70; D06F 2105/50; D06F 2105/52–62; D06F 2202/00–12;
(Continued)

(56) References Cited

U.S. PATENT DOCUMENTS 9,428,854 B2 8/2016 Dunn et al.
9,644,311 B2 5/2017 Kulkarni et al.
(Continued)

FOREIGN PATENT DOCUMENTS

CA 2353012 C 8/2009
CN 101768848 A 7/2010
(Continued)

*Primary Examiner* — David G Cormier
(74) *Attorney, Agent, or Firm* — Dority & Manning, P.A.

(57) ABSTRACT

A washing machine appliance and a method of preventing and mitigating out-of-balance conditions during a spin cycle are provided. In one example aspect, liquid is flowed into the tub and articles within a basket rotatably mounted in a tub of the washing machine appliance are agitated for a first time period. The movement of the tub during the first time period is measured and a trend line is calculated based on the movement of the tub over the first time period. A time remaining is calculated based at least in part on the trend line. If the time remaining is less than a time remaining threshold, and if the determined time remaining is less than the time remaining threshold, the articles within the basket are agitated by an extended agitation time period in which the washing machine appliance attempts to more evenly distribute the articles prior to a spin cycle.

20 Claims, 10 Drawing Sheets

(51) Int. Cl.
*D06F 37/24* (2006.01)
*D06F 35/00* (2006.01)
*D06F 37/40* (2006.01)

(52) U.S. Cl.
CPC ..... *D06F 37/40* (2013.01); *D06F 2202/065* (2013.01); *D06F 2212/02* (2013.01); *D06F 2222/00* (2013.01)

(58) Field of Classification Search
CPC ..... D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

| | | | | |
|---|---|---|---|---|
| 9,915,023 | B2 | 3/2018 | Noh et al. | |
| 10,000,875 | B2 | 6/2018 | Davis et al. | |
| 10,000,876 | B2 | 6/2018 | Davis | |
| 10,000,877 | B2 | 6/2018 | Davis et al. | |
| 10,030,330 | B2 | 7/2018 | Leibman et al. | |
| 2006/0242769 | A1* | 11/2006 | Borras | D06F 37/203 8/159 |
| 2010/0175199 | A1* | 7/2010 | Kim | D06F 37/203 8/137 |
| 2012/0125095 | A1* | 5/2012 | Park | D06F 33/00 73/290 R |
| 2016/0312394 | A1 | 10/2016 | Wang et al. | |
| 2017/0298553 | A1 | 10/2017 | Dunn et al. | |
| 2017/0298554 | A1 | 10/2017 | Davis et al. | |
| 2017/0298555 | A1 | 10/2017 | Davis | |
| 2017/0298556 | A1 | 10/2017 | Davis et al. | |
| 2018/0016728 | A1 | 1/2018 | Davis | |
| 2018/0057988 | A1 | 3/2018 | Davis | |

FOREIGN PATENT DOCUMENTS

| | | | |
|---|---|---|---|
| CN | 104593995 | A | 5/2015 |
| CN | 104032538 | B | 12/2016 |
| CN | 104775274 | B | 3/2018 |
| EP | 2666899 | A1 | 11/2013 |
| VN | 10013627 | B | 2/2015 |

* cited by examiner

WASHING MACHINE APPLIANCE AND METHODS FOR PREVENTING SPIN OUT-OF-BALANCE CONDITIONS

FIELD OF THE INVENTION

The present disclosure relates generally to washing machine appliances, such as vertical axis washing machine appliances, and methods for preventing spin out-of-balance conditions in such washing machine appliances.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A wash basket is rotatably mounted within the wash tub and defines a wash chamber for receipt of articles for washing. A drive assembly is coupled to the wash tub and configured to selectively rotate the wash basket within the wash tub.

Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or an agitation element can rotate at various speeds to agitate or impart motion to articles within the wash chamber. During a spin cycle, the wash basket may be rotated at high speeds, e.g., to wring wash fluid from articles within the wash chamber.

A significant concern during operation of washing machine appliances is out-of-balance conditions within the wash tub. For example, articles and water loaded within a wash basket may not be equally weighted about a central axis of the wash basket and wash tub. Accordingly, when the wash basket rotates, in particular during a spin cycle, the imbalance in clothing weight may cause the wash basket to be out-of-balance within the wash tub such that the axis of rotation does not align with the axis of the cylindrical wash basket or wash tub. Such out-of-balance issues can cause the wash basket to contact the wash tub during rotation and can further cause movement of the wash tub within the cabinet. Significant movement of the wash tub can, in turn, generate increased noise, vibrations, washer "walking," and/or cause excessive wear and premature failure of appliance components.

Various methods are known for monitoring load balances and preventing out-of-balance scenarios within washing machine appliances. Such monitoring and prevention may be especially important, for instance, during the high-speed rotation of the wash basket, e.g., during a spin cycle. However, such methods typically monitor load balance and detect out-of-balance states during the spin cycle, when the wash basket is already spinning at a high rate of speed. Accordingly, noise, vibration, movement, or damage may occur despite the out-of-balance detection.

Accordingly, improved methods and apparatus for preventing out-of-balance loads during the spin cycle in washing machine appliances are desired.

BRIEF DESCRIPTION OF THE INVENTION

Aspects and advantages of the invention will be set forth in part in the following description, or may be apparent from the description, or may be learned through practice of the invention.

In one exemplary embodiment, a method for operating a washing machine appliance is provided. The method includes flowing a volume of liquid into a tub of the washing machine appliance. The method also includes agitating articles within a basket rotatably mounted within the tub for a first time period. Further, the method includes measuring movement of the tub during the first time period. Moreover, the method includes calculating a trend line based at least in part on movement of the tub during the first time period. In addition, the method includes determining a time remaining based at least in part on the trend line. The method also includes ascertaining whether the time remaining is less than a time remaining threshold. In addition, the method includes agitating articles within the basket for an extended agitation time period based at least in part on whether the determined time remaining is less than the time remaining threshold.

In another exemplary embodiment, a washing machine appliance is provided. The washing machine appliance includes a tub positioned within a cabinet and a basket rotatably mounted within the tub, the basket defining a wash chamber for receipt of articles for washing. The washing machine appliance also includes an agitation element positioned in the wash basket. Further, the washing machine appliance includes a motor in mechanical communication with the wash basket and the agitation element, the motor being configured for selectively rotating the wash basket and the agitation element within the tub. In addition, the washing machine appliance includes a measurement device mounted to the tub and a water control valve for regulating a flow of water from a water supply source into the tub. Further, the washing machine appliance includes a controller communicatively coupled with the motor, the measurement device, and the water control valve. The controller is configured to: regulate the water control valve to flow a volume of water into the tub; operate the motor to rotate the agitation element for a first time period; receive, from the measurement device, movement measurements of the tub during the first time period; calculate a trend line based at least in part on movement measurements of the tub during the first time period; determine a time remaining based at least in part on the trend line; ascertain whether the determined time remaining is greater than a first time remaining threshold; ascertain whether the determined time remaining is less than a second time remaining threshold; and operate the motor to rotate the agitation element for an extended agitation time period based at least in part on whether the determined time remaining is greater than the first time remaining threshold and less than the second time remaining threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
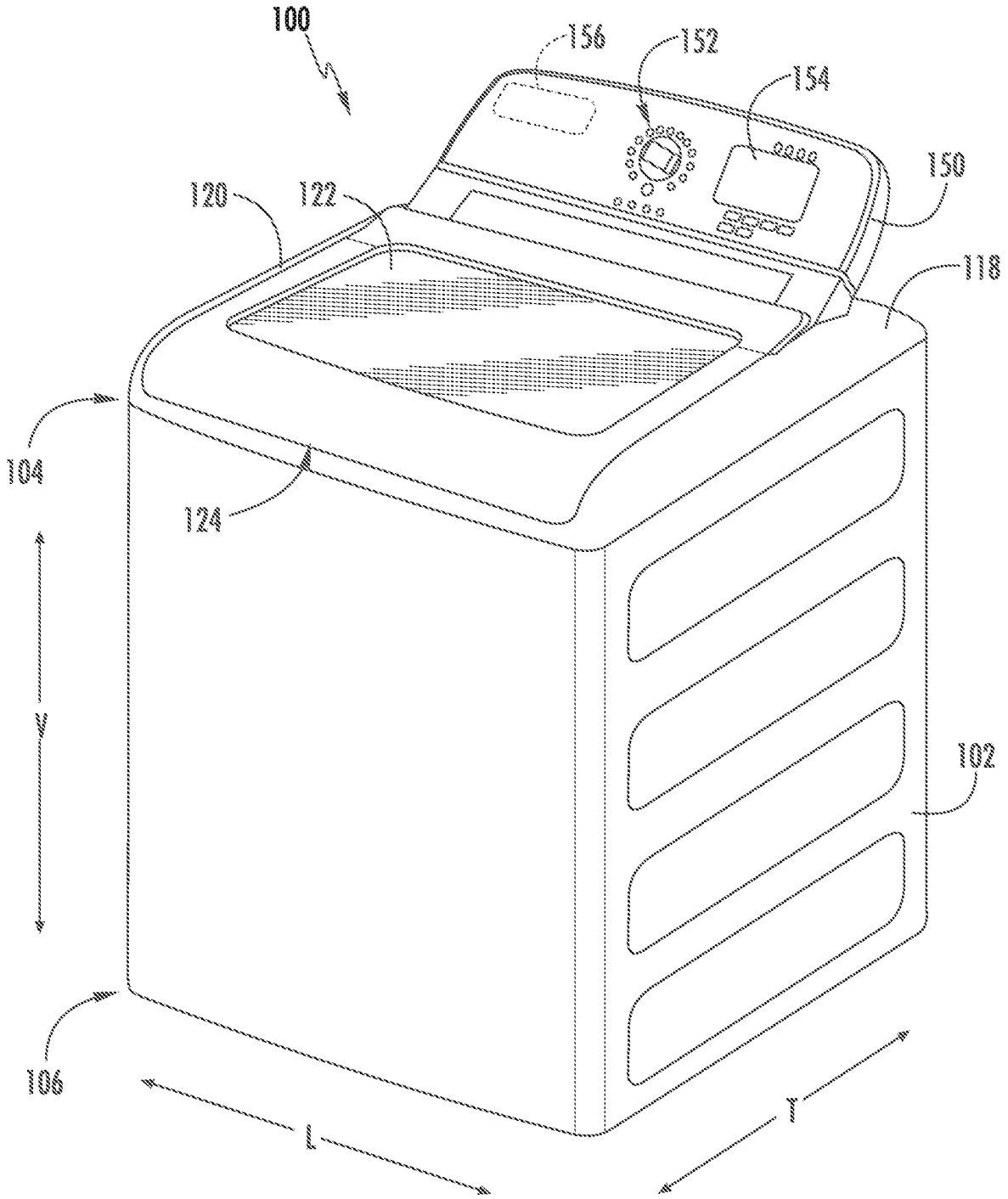
FIG. 1 provides a perspective view of a washing machine appliance according to an exemplary embodiment of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent (10%) margin of error.

Figure 2:
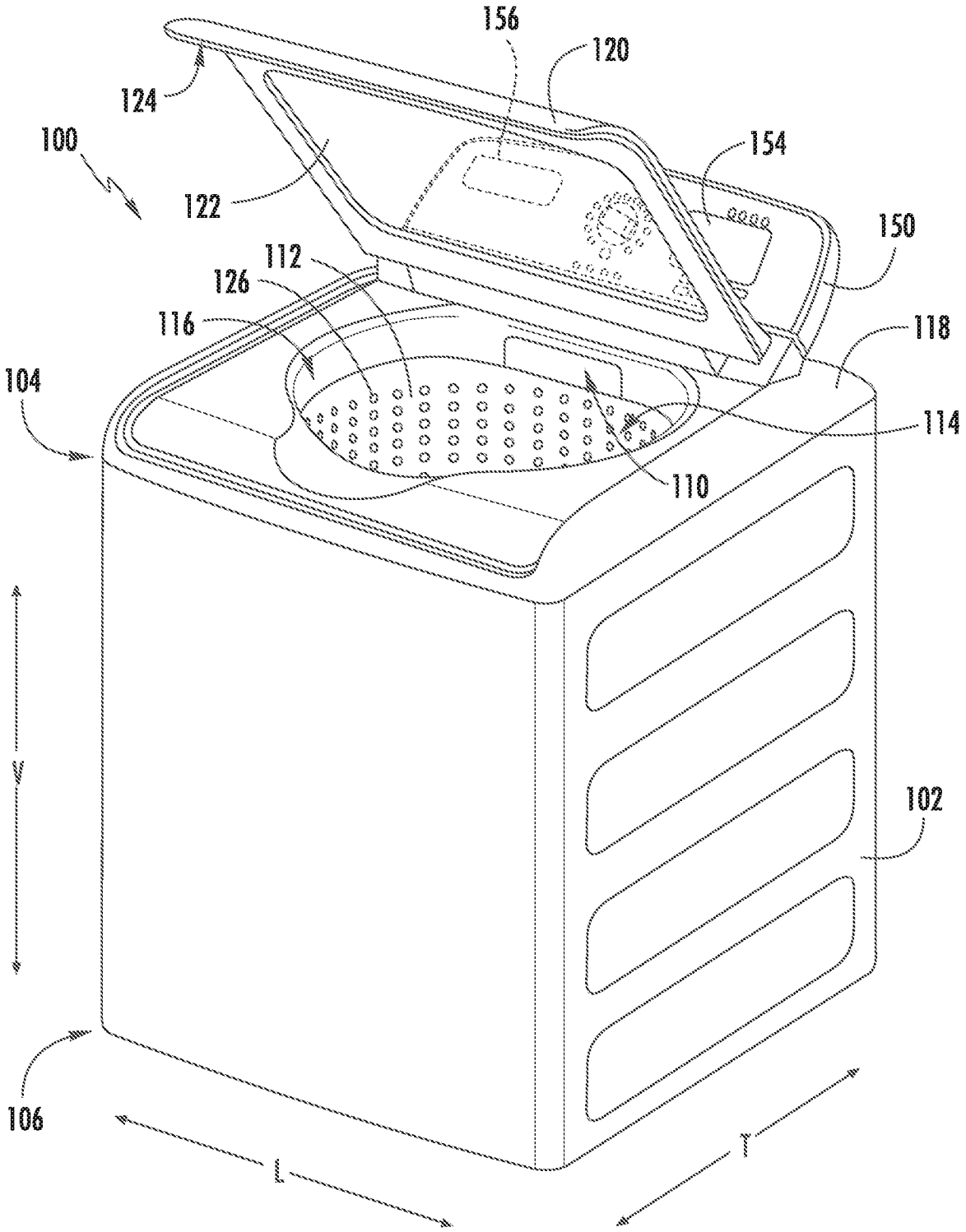
FIG. 2 provides a perspective view of the washing machine appliance of FIG. 1 with the door of the exemplary washing machine appliance shown in an open position.
Figure 3:
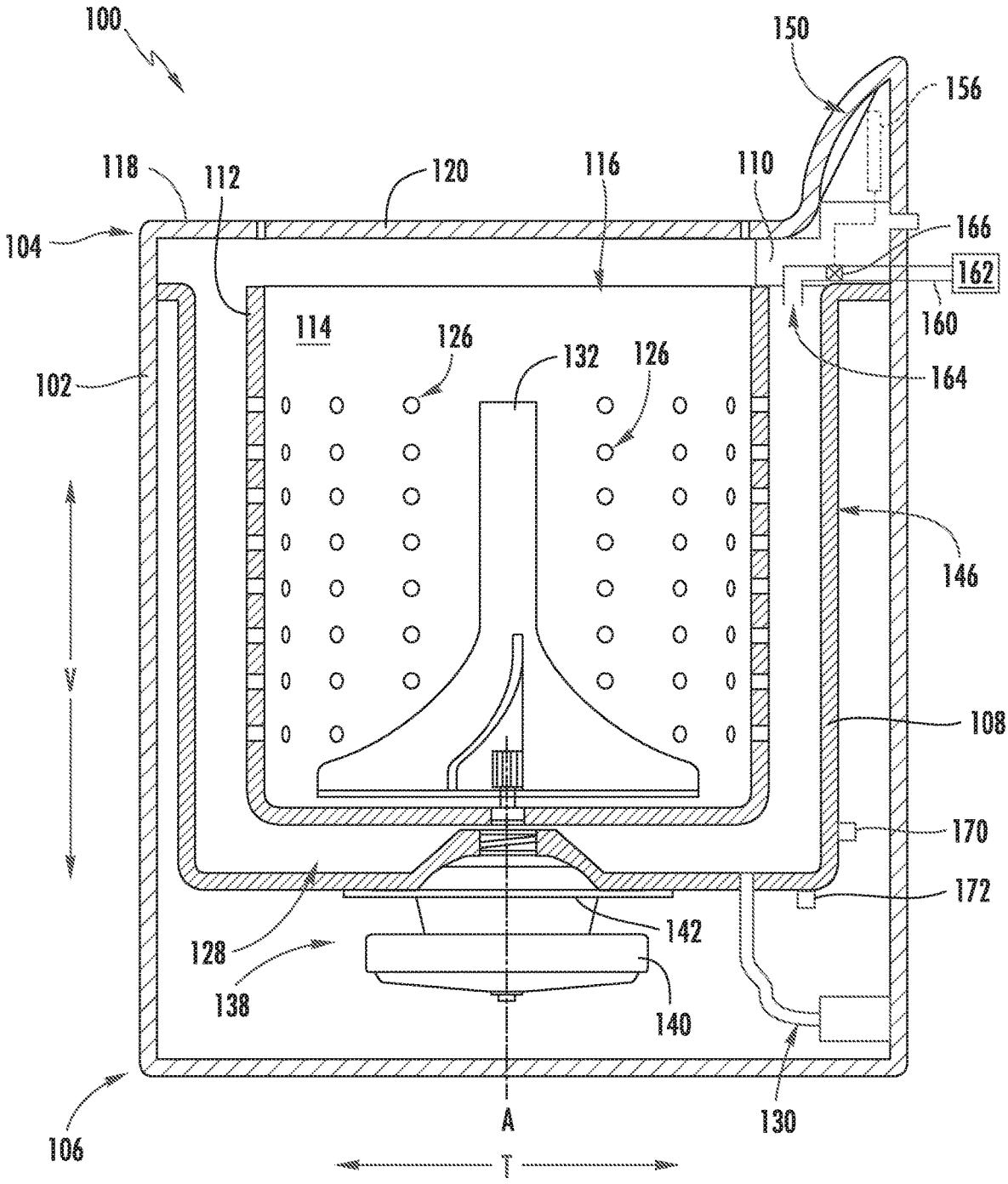
FIG. 3 provides a side, cross sectional view of the washing machine appliance of FIG. 1 according to an exemplary embodiment of the present subject matter.
Figure 4:
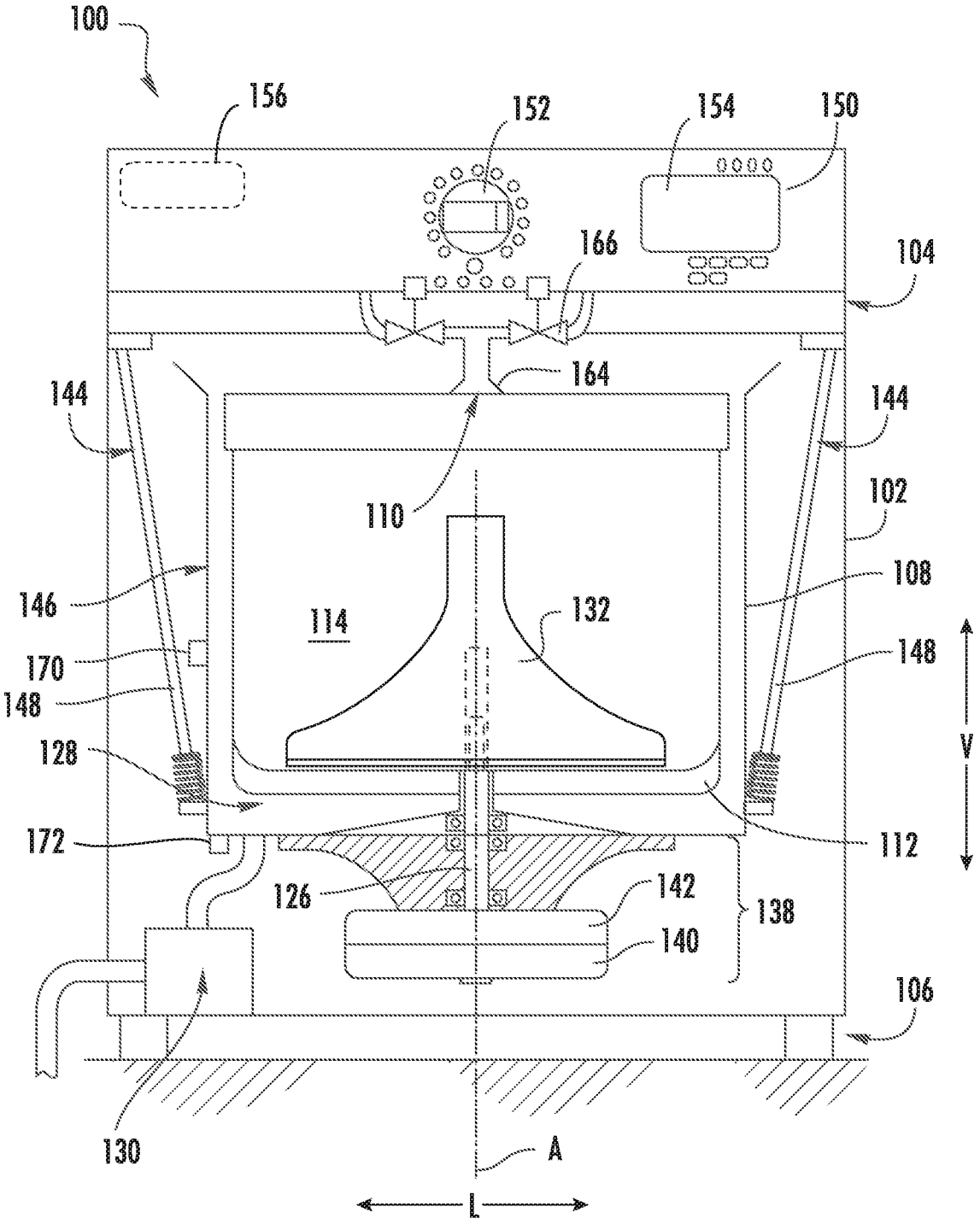
FIG. 4 provides a schematic, front view of the washing machine appliance of FIG. 1 according to example embodiments of the present subject matter.

FIGS. 1 through 4 illustrate an exemplary embodiment of a vertical axis washing machine appliance 100. Specifically, FIGS. 1 and 2 illustrate perspective views of washing machine appliance 100 in a closed and an open position, respectively. FIGS. 3 and 4 provide side and front cross-sectional views of washing machine appliance 100, respectively. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle. Washing machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 112 that is positioned within tub 108 and generally defines a wash chamber 114 including an opening 116 for receipt of articles for washing. More specifically, wash basket 112 is rotatably mounted within tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, as noted above, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Washing machine appliance 100 further includes a pump assembly 130 (FIG. 3) that is located beneath tub 108 and wash basket 112 for gravity assisted flow when draining tub 108, e.g., after a wash or rinse cycle.

An impeller or agitation element 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitation element 132 extends into wash basket and assists agitation of articles disposed within wash basket 112 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 112 are oriented to rotate about the axis of rotation A (which is substantially parallel to vertical direction V).

As best illustrated in FIGS. 3 and 4, washing machine appliance 100 includes a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitation element 132. In this manner, drive assembly 138 may be configured for selectively rotating or oscillating wash basket 112 and/or agitation element 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitation element 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Turning to FIG. 4, washing machine appliance 100 may include a vibration damping system or suspension system 144 which generally operates to damp or reduce dynamic motion and absorb vibrations of a subwasher 146. As used herein, the term "subwasher" is used generally to refer to those components of a washing machine appliance suspended within the appliance cabinet by a suspension system or assembly. For example, according to the illustrated embodiment, subwasher 146 is suspended within cabinet 102 by suspension system 144 and includes tub 108, wash basket 112, agitation element 132, drive assembly 138, and other components.

Suspension system 144 can include one or more suspension springs 148 for supporting subwasher 146 and absorbing the forces resulting from the movement of wash basket 112 within the tub 108. Specifically, according to an exemplary embodiment, suspension system 144 includes four suspension springs 148 which are spaced apart about the tub 108. For example, each suspension springs 148 may be connected at one end proximate a corner of cabinet 102 and at an opposite end to tub 108. According to alternative embodiments, washing machine appliance 100 may further include other vibration dampening elements, such as balance rings positioned at around the upper and/or lower circumferential surfaces of the wash basket 112. Balance rings may be used to counterbalance an out-of-balance condition for washing machine appliance 100 as wash basket 112 rotates within tub 108.

Referring to FIGS. 1 through 4, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is communicatively coupled with control panel 150 for user manipulation to select washing machine cycles and features. In response to user manipulation of control panel 150, controller 156 operates the various components of washing machine appliance 100 to execute selected machine cycles and features. As described in more detail below with respect to FIG. 5, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

Figure 5:
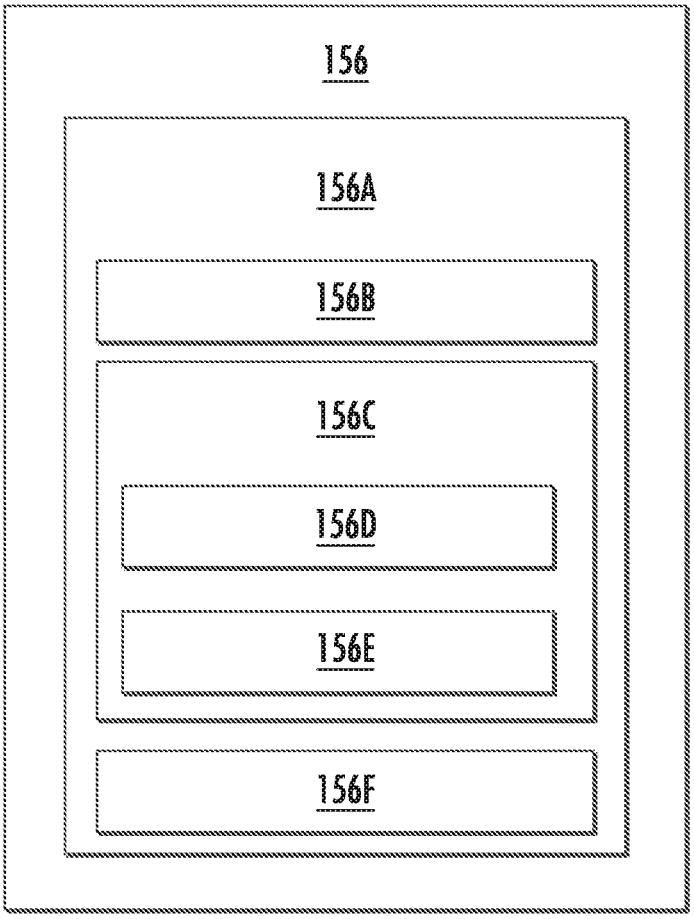
FIG. 5 depicts certain components of a controller according to example embodiments of the present subject matter.

FIG. 5 provides a schematic view of various components of controller 156 according to example embodiments of the present disclosure. Controller 156 can include one or more computing device(s) 156A which may be used to implement methods as described herein. Computing device(s) 156A can include one or more processor(s) 156B and one or more memory device(s) 156C. The one or more processor(s) 156B can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 156C can include one or more non-transitory computer-readable storage medium(s), such as RAM, ROM, EEPROM, EPROM, flash memory devices, magnetic disks, etc., and/or combinations thereof.

The memory device(s) 156C can include one or more computer-readable media and can store information accessible by the one or more processor(s) 156B, including instructions 156D that can be executed by the one or more processor(s) 156B. For instance, the memory device(s) 156C can store instructions 156D for running one or more software applications, displaying a user interface, receiving user input, processing user input, etc. In some implementations, the instructions 156D can be executed by the one or more processor(s) 156B to cause the one or more processor(s) 156B to perform operations, e.g., such as one or more portions of methods described herein. The instructions 156D can be software written in any suitable programming language or can be implemented in hardware. Additionally, and/or alternatively, the instructions 156D can be executed in logically and/or virtually separate threads on processor(s) 156B.

The one or more memory device(s) 156C can also store data 156E that can be retrieved, manipulated, created, or stored by the one or more processor(s) 156B. The data 156E can include, for instance, data to facilitate performance of methods described herein. The data 156E can be stored in one or more database(s). The one or more database(s) can be connected to controller 156 by a high bandwidth LAN or WAN, or can also be connected to controller through network(s) (not shown). The one or more database(s) can be split up so that they are located in multiple locales. In some implementations, the data 156E can be received from another device.

The computing device(s) 156A can also include a communication module or interface 156F used to communicate with one or more other component(s) of controller 156 or washing machine appliance 100 over the network(s). The communication interface 156F can include any suitable components for interfacing with one or more network(s), including for example, transmitters, receivers, ports, controllers, antennas, or other suitable components.

With reference to FIGS. 1 through 5, during operation of washing machine appliance 100, laundry items are loaded into wash basket 112 through opening 116, and washing operation is initiated through operator manipulation of input selectors 152. Wash basket 112 is filled with water and detergent and/or other fluid additives via primary dispenser 110. One or more valves can be controlled by washing machine appliance 100 to provide for filling tub 108 and wash basket 112 to the appropriate level for the amount of articles being washed and/or rinsed. By way of example, for a wash mode, once wash basket 112 is filled with fluid to the appropriate level, the contents of wash basket 112 can be agitated (e.g., with agitation element 132 as discussed previously) for washing of laundry items in wash basket 112.

More specifically, referring to FIGS. 3 and 4, a water fill process will be described according to an exemplary embodiment. As illustrated, washing machine appliance 100 includes a water supply conduit 160 (FIG. 3) that provides fluid communication between a water supply source 162 (FIG. 3; such as a municipal water supply) and a discharge nozzle 164 for directing a flow of water into tub 108, and more specifically, into wash chamber 114. In addition, washing machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. In addition, washing machine appliance 100 may include one or more pressure sensors 170 (FIG. 4) for detecting the amount of water and or clothes within tub 108. For example, pressure sensor 170 may be operably coupled to a side of tub 108 for detecting the weight of tub 108.

After tub 108 is filled and the agitation phase of the wash cycle is completed, wash basket 112 can be drained, e.g., by drain pump assembly 130. Laundry articles can then be rinsed by again adding fluid to wash basket 112 depending on the specifics of the cleaning cycle selected by a user. The impeller or agitation element 132 may again provide agitation within wash basket 112. One or more spin cycles may also be used as part of the cleaning process. In particular, a spin cycle may be applied after the wash cycle and/or after the rinse cycle in order to wring wash fluid from the articles being washed. During a spin cycle, wash basket 112 is rotated at relatively high speeds to help wring fluid from the laundry articles through perforations 126. After articles disposed in wash basket 112 are cleaned and/or washed, the user can remove the articles from wash basket 112, e.g., by reaching into wash basket 112 through opening 116.

Referring still to FIGS. 3 and 4, one or more measurement devices 172 may be provided in the washing machine appliance 100 for measuring movement of tub 108, in particular during rotation of wash basket 112 prior to the spin cycle. Specifically, for example, movement of tub 108 may be measured as one or more displacement readings, e.g., certain displacement amplitudes measured at the center of gravity of tub 108. Measurement devices 172 may measure a variety of suitable variables that can be correlated to movement of tub 108. The movement measured by such devices 172 can be utilized to, e.g., determine the displacement amplitudes of tub 108 at the center of gravity or other locations, and to adjust operation of washing machine appliance 100 to facilitate agitation in a particular manner and/or for particular time periods to adjust the load balance state, e.g., to attempt to balance articles within wash basket 112 prior to a spin cycle.

In some embodiments, measurement device 172 may include an accelerometer which measures translational motion, such as acceleration along one or more directions. Additionally or alternatively, measurement device 172 may include a gyroscope, which measures rotational motion, such as rotational velocity about an axis. Moreover, according to exemplary embodiments, measurement device 172 may include more than one gyroscope and/or more than one accelerometer.

Control panel 150 and other components of washing machine appliance 100, such as drive assembly 138 and measurement device 172, may be communicatively coupled with controller 156 via one or more signal lines or shared communication busses. According to exemplary embodiments, measurement devices 172 may include a dedicated microprocessor that performs the calculations specific to the measurement of motion with the calculation results being used by controller 156.

According to the illustrated embodiment, measurement device 172 is mounted to tub 108 to sense movement of tub 108 relative to the cabinet 102, e.g., by measuring uniform periodic motion, non-uniform periodic motion, or excursions of the tub 108 during appliance 100 operation. For instance, movement may be measured as discrete identifiable components (e.g., in a predetermined direction). More specifically, according to the illustrated embodiment, measurement device 172 is mounted to a bottom wall of tub 108, though other suitable positions on subwasher 146 are possible. Controller 156 may use measurement device 172 to determine the movement of any other position on tub 108, such as the center of gravity of tub 108. However, it should be appreciated that according to alternative embodiments, any suitable number, type, and position of measurement devices may be used.

The measurement device 172 may be mounted to tub 108 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to tub 108 at a single location (e.g., the location of the printed circuit board or other component of the measurement device 172 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 108 can measure the rotation of a gyroscope located at a different location on tub 108, because rotation about a given axis is the same everywhere on a solid object such as tub 108.

Figure 6:
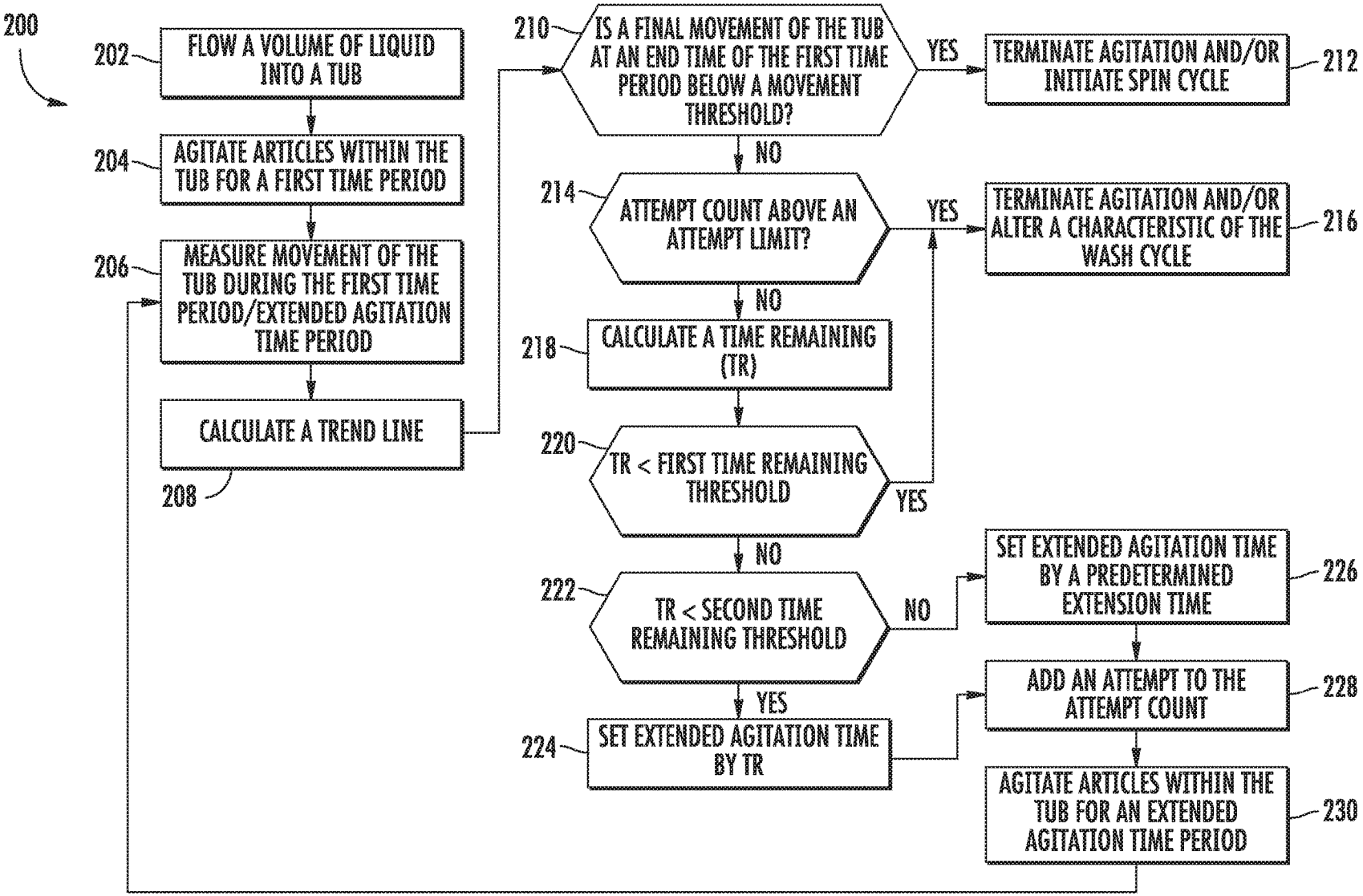
FIG. 6 provides a flow diagram of an exemplary method for operating a washing machine appliance according to example embodiments of the present subject matter.

FIG. 6 provides a flow diagram of an exemplary method (200) for operating a washing machine appliance according to example embodiments of the present subject matter. For instance, the exemplary method (200) may be utilized to operate the washing machine appliance 100 and components thereof of FIGS. 1 through 5. Accordingly, the method (200) will be described below in the context of operating washing machine appliance 100. However, it will be appreciated that the exemplary method (200) is applicable to operation of a variety of other washing machine appliances, such as horizontal axis washing machine appliances. Further, it should be appreciated that variations and modifications to method (200) are possible and within the scope of the present subject matter.

At (202), the method (200) includes flowing a volume of liquid into a tub of the washing machine appliance. For instance, to commence a wash cycle, a volume of water and/or detergent (i.e., wash fluid) may be flowed into tub 108 of washing machine appliance 100. For example, controller 156 may regulate water control valve 166 to dispense a predetermined amount of water from water supply source 162 into tub 108 through discharge nozzle 164.

At (204), the method (200) includes agitating articles within the tub for a first time period. For instance, during the agitation phase of the wash cycle, agitation element 132 may be driven about the axis of rotation A by drive assembly 138 to agitate the articles within tub 108. The first time period may be any suitable length of time. The first time period may be dictated by the size of the load, the cycle selected by the user, etc. The first time period extends from a start time to an end time. Controller 156 may track the first time period. According to an exemplary implementation of method (200), liquid is provided to tub 108 at (202) and articles within tub 108 are agitated during the first time period at (204) prior to a spin cycle of washing machine appliance 100. In this manner, an out-of-balance prevention process may be performed prior to spinning wash basket 112 at high speeds during the spin cycle, thereby reducing the likelihood of excessive tub displacement, vibrations, noise, and impact during the spin cycle.

At (206), the method (200) includes measuring movement of the tub during the first time period. For instance, in some implementations, measuring movement of the tub during the first time period includes measuring a displacement amplitude of the tub during the first time period using a measurement device. For example, measurement device 172 described herein may be used to measure the displacement amplitude of tub 108 during the first time period. In some implementations, measurement device 172 may be used to measure the displacement amplitude at the center of gravity of tub 108. By placing measurement device 172 on the bottom of tub 108 (e.g., a rigid body), measurements obtained may be used to determine the displacement of tub 108 at the center of gravity using a transfer function based on the geometry of tub 108. Determining displacement amplitudes of tub 108 during the first time period may be accomplished as described in US Patent Publication US2018/0057988, which is hereby incorporated by reference in its entirety. Additionally or alternatively, in some exemplary implementations of method (200), the movement of tub 108 may be measured by other parameters. For instance, instantaneous, local maximum, or local averages of tub motion may be used as well.

Figure 7:
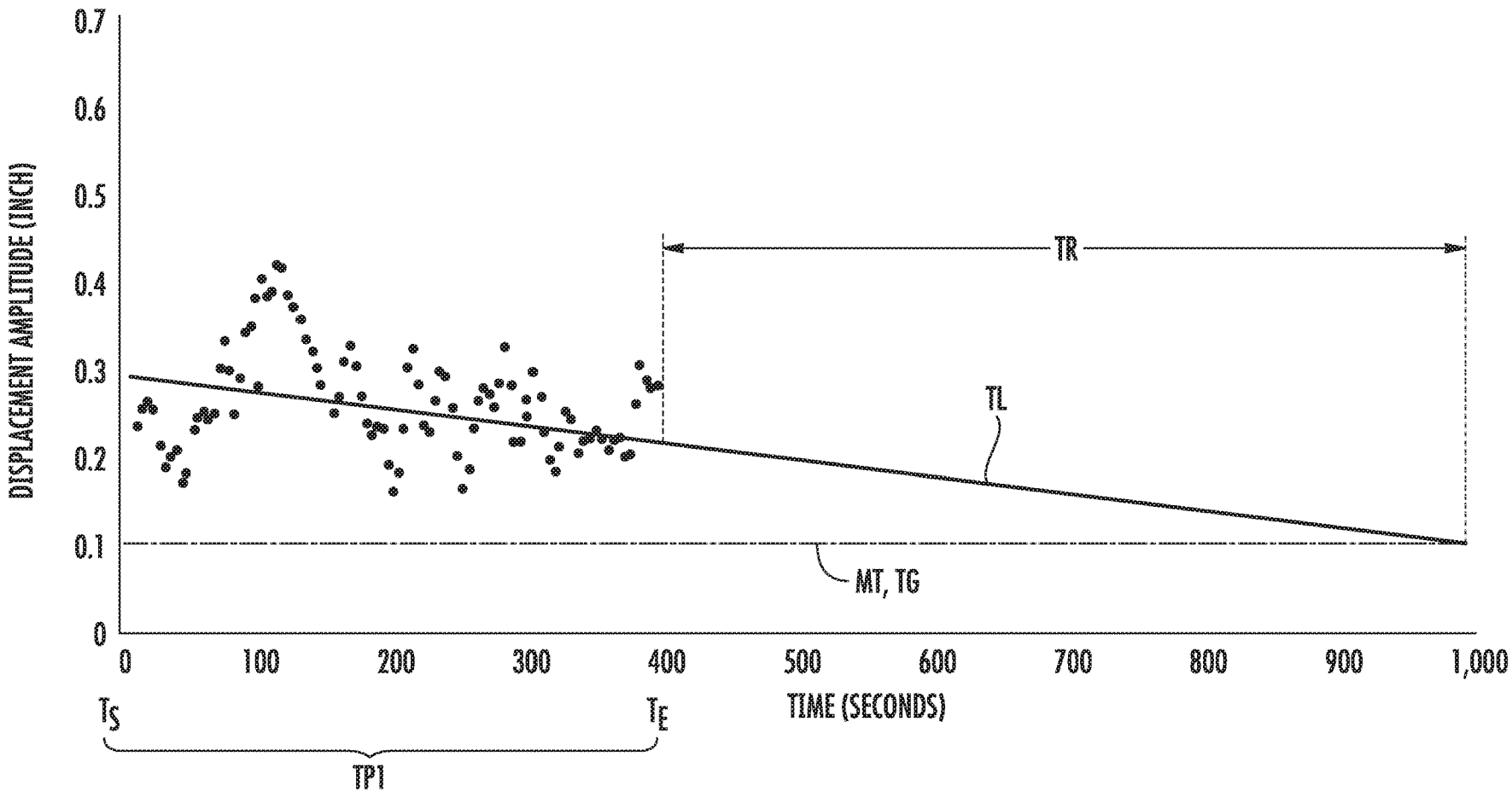
FIG. 7 provides a graph specifying tub movement as a function of time according to example embodiments of the present subject matter.

The movement measurements of tub 108 (e.g., displacement amplitudes) over the first time period may be stored (e.g., in a memory device 156C of controller 156) as a plurality of data points. The data points are representative of movement of the tub 108 over the first time period. The data points may be plotted as a function of time. For instance, as shown in FIG. 7, a plurality of data points are plotted as displacement amplitudes of tub 108 over the first time period. The start time of the first time period is labeled as $t_S$ at time t=0 seconds and the end time of the first time period is labeled as $t_E$ at t=400 seconds. The first time period is labeled as TP1. As will be explained below, a trend line or function, labeled as TL, may be calculated based on the movement of the tub during the first time period, or more specifically, the plurality of data points measured over the first time period.

At (208), with reference again to FIG. 6, the method (200) includes calculating a trend line based at least in part on movement of the tub during the first time period. In some implementations, the trend line specifies the displacement amplitude of the tub versus time. The trend line may be calculated as a linear trend line, an exponential function, a polynomial function, a moving average, etc. As one example, the trend line may be calculated as a linear trend line via a linear regression technique, e.g. using the exemplary linear regression equation below:

$$Y=mX+b \quad \text{(Eq. 1)}$$

where Y the dependent value is tub movement (e.g., a displacement amplitude), X the independent value is time, m is the slope of the linear function, and b is the Y-intercept. The slope m and the Y-intercept b may be calculated for n number of data points by the following equations, respectively:

$$m = \frac{n\sum(XY) - \sum(X)\sum(Y)}{n\sum(X^2) - \sum(X)^2} \quad \text{(Eq. 2)}$$

$$b = \frac{\sum(Y)\sum(X^2) - \sum(X)\sum(XY)}{n\sum(X^2) - \sum(X)^2} \quad \text{(Eq. 3)}$$

As shown in FIG. 7, continuing with the example above, the trend line TL was calculated based at least in part on the plurality of data points. Particularly, the trend line TL was calculated utilizing the linear regression equation noted above (i.e., Eq. 1). Thus, based on the data points measured for the first time period TP1, the trend line TL was calculated having the following equation:

$$Y=-0.0002X+0.2984 \quad \text{(Eq. 4)}$$

The load distribution evenness of the articles within wash chamber 114 of basket 112 may evaluated over time using the trend line TL. A decreasing trend line TL indicates a decrease in tub motion over time and that the load (i.e., the articles within wash basket 112) is becoming more evenly distributed within basket 112. In contrast, an increasing trend line TL indicates an increase in tub motion over time and that the load is becoming less evenly distributed over time. A neither decreasing nor increasing trend line TL indicates that the tub motion is neither decreasing nor increasing over time and that the load is neither becoming less or more evenly distributed over time. For the illustrated example of FIG. 7, the trend line TL is decreasing over time, and consequently, the trend line TL indicates a decrease in tub motion over time and that the load (i.e., the articles within wash basket 112) is becoming more evenly distributed within basket 112. However, if the trend line TL had a positive slope m, the trend line TL would indicate an increase in tub motion over time and that the load is becoming less evenly distributed over time. As will be explained below, the trend line TL may be utilized to determine a time remaining to reach or exceed certain thresholds.

At (210), with reference again to FIG. 6, in some implementations the method (200) includes determining whether a final movement of the tub at an end time of the first time period is below a movement threshold. For instance, controller 156 may compare the final movement (e.g., the displacement amplitude) of tub 108 at the end time of the first time period to the movement threshold. The movement threshold may be set at any suitable value. For example, with reference to FIG. 7, the movement threshold MT may be set at a displacement amplitude of 0.1 inches. If the final movement is below the movement threshold MT, a spin cycle may proceed in a safe manner. Thus, if the final movement (e.g., the displacement amplitude) of the tub at the end time $t_E$ of the first time period TP1 is below the movement threshold MT, the method (200) proceeds to (212) as shown in FIG. 6. In the example of FIG. 7, the final movement of the tub at the end time $t_E$ of the first time period TP1 is above the movement threshold MT as the final movement of the tub was measured having a displacement amplitude of about 0.28 inches and the movement threshold MT was set at a displacement amplitude of 0.1 inches. However, if the final movement of the tub at the end time $t_E$ of the first time period TP1 is not below the movement threshold MT (i.e., the final movement of the tub at the end time of the first time period is equal to or above the movement threshold), then the method (200) proceeds to (214). In this way, action may be taken to even the load within basket 112 prior to entering a spin cycle, and consequently, out-of-balance conditions may be prevented, among other benefits.

At (212), if the final movement is below the movement threshold as determined at (210), the method (200) includes terminating agitation of the articles within the wash chamber and/or initiating a spin cycle. As noted above, if the final movement is below the movement threshold, the load is evenly distributed within basket 112 and a spin cycle may thus be initiated. In general, terminating agitation of articles within basket 112 includes disengaging agitation element 132 from drive assembly 138 (e.g., via a clutch mechanism) such that agitation element 132 ceases being driven about the axis of rotation A. Basket 112 may remain engaged with drive assembly 138 so that basket 112 may be spun about the axis of rotation A during the spin cycle. Initiating the spin cycle may include activating a drain pump assembly (e.g., drain pump assembly 130) to drain the liquid from tub 108. The spin cycle may then include operating the motor to spin the wash basket at a relatively high speed.

At (214), if the final movement is not below the movement threshold as determined at (210), the method (200) includes determining whether an attempt count is above an attempt limit. Controller 156 may keep or maintain a count of the number of attempts taken by the system to alleviate an out-of-balance load. The attempt limit may be set to any suitable limit, such as e.g., three (3) counts. If the attempt count is not above the attempt limit (i.e., the attempt count is equal to or below the attempt limit), the method (200) proceeds to (218) such that the system may attempt to more evenly distribute the load within basket 112 prior to the spin cycle. If the attempt count is above the attempt limit, the method (200) proceeds to (216).

At (216), the method (200) includes terminating agitation of the articles within the wash chamber and/or altering a characteristic of the wash cycle or washing machine appliance. For instance, terminating agitation of the articles within the wash chamber may be accomplished as described above at (212). Controller 156 of washing machine appliance 100 may control washing machine appliance 100 to alter one or more characteristics of the ongoing phase of the wash cycle (e.g., rotational speed, acceleration, etc.) in an attempt to more evenly distribute the load within basket 112. For instance, the rotational speed of basket 112 may be reduced, a volume of water may be added to wash chamber 114, and/or the agitation stroke of agitation element 132 may be reduced in an attempt to more evenly distribute the load within basket 112.

At (218), the method (200) includes determining a time remaining based at least in part on the trend line. Particularly, for this embodiment, if the attempt count is not above the attempt limit as determined at (214), the method (200) includes determining a time remaining based at least in part on the trend line. The time remaining is associated with the remaining time in which the articles within basket 112 are agitated. Thus, the time remaining may be deemed the agitation time remaining. In short, determining the time remaining includes calculating a predicted time utilizing the trend line, wherein the predicted time is predictive of a time in which movement of the tub is equal to a preselected movement target. Further, determining the time remaining includes subtracting a current time from the determined predicted time. The current time subtracted from the determined predicted time is the time remaining. An exemplary manner in which the time remaining may be determined is provided below.

In one exemplary implementation of method (200), the time remaining may be calculated by the following equation:

$$\text{Time Remaining(TR)}=\text{Predicted time}-\text{Current time} \quad \text{(Eq. 5)}$$

The current time may be time stamped by controller 156 upon or after it is determined at (214) that the attempt count is below the attempt limit, at the end time of the first time period, upon or after it is determined at (210) that the final movement of the tub is above the movement threshold, etc. Suppose for the example in FIG. 7 that the current time is t=400 seconds, or the end time $t_E$ of the first time period TP1. The predicted time is based on the trend line calculated at (208). Particularly, a preselected movement target TG (e.g., a preselected displacement amplitude) is inserted into the trend line equation (e.g., (Eq. 4)) as the tub movement value Y and controller 156 solves for X, or the predicted time. By way of example, using (Eq. 4) and supposing the preselected movement target TG is set at a displacement amplitude of 0.1 inches (the same displacement amplitude as the movement threshold MT), the predicted time may be solved as shown below:

$$Y=-0.0002X+0.2984$$

$$0.1=-0.0002X+0.2984$$

$$X=992 \text{ seconds}$$

Then, using (Eq. 5), the time remaining may be solved as shown below by subtracting the current time from the predicted time:

$$\text{Time Remaining(TR)}=\text{Predicted time}-\text{Current time}$$

$$\text{TR}=992 \text{ seconds(Predicted time)}-400 \text{ seconds(Current time)}$$

$$\text{TR}=592 \text{ seconds}$$

Accordingly, for this example, the time remaining is five hundred ninety-two (592) seconds, or about 9.8 minutes. The time remaining TR for the example above is shown in FIG. 7.

Further, in some implementations, the preselected movement target TG may be set at a different value than the movement threshold MT. For instance, the movement threshold MT may be set at a displacement amplitude of 0.1 inches at (210) and the preselected movement target TG may be set at a displacement amplitude of 0.2 inches at (218). In such implementations, the time remaining would be ninety-two (92) seconds, or about one and a half (1.5) minutes. As shown in FIG. 7, the trend line TL crosses the preselected movement target TG of 0.2 inches ninety-two (92) seconds after t=400 seconds.

At (220), the method (200) includes ascertaining whether the determined time remaining is less than a first time remaining threshold. For instance, in some implementations, the first time remaining threshold may be set equal to zero (0) seconds by controller 156. Thus, if the time remaining is negative (i.e., the current time is greater than the predicted time), then the method (200) proceeds to (216) so that agitation of the articles within the wash chamber may be terminated and/or one or more characteristics of the wash cycle may be altered as described above. If the time remaining is positive (i.e., the current time is equal to or less than the predicted time), then the method (200) proceeds to (222) where the time remaining is compared to a second time remaining threshold.

At (222), the method (200) includes ascertaining whether the determined time remaining is less than a second time remaining threshold. For instance, in some implementations, the second time remaining threshold may be set equal to one hundred eighty (180) seconds (three (3) minutes) by controller 156. On one hand, if the time remaining calculated at (218) is less than the second time remaining threshold, then the method (200) proceeds to (224) where controller 156 increases the agitation phase of the wash cycle by the determined time remaining, e.g., to better evenly distribute the load within basket 112 prior to the spin cycle. If, on the other hand, the time remaining is not less than the second time remaining threshold (i.e., the time remaining is equal to or greater than the second time remaining threshold), then the method (200) proceeds to (226).

At (224), as noted above, the method (200) includes setting the extended agitation time period by the determined time remaining. Accordingly, as will be explained at (230), agitation element 132 is controlled by controller 156 to continue to agitate the load within basket 112 for the time remaining in an attempt to more evenly distribute the load prior to the spin cycle. This may, for example, reduce the probability of out-of-balance conditions during the spin cycle, among other benefits. After increasing the agitation time of the articles within the tub by the determined time remaining, the method (200) proceeds to (228).

At (226), if the time remaining is not less than the second time remaining threshold, then the method (200) includes setting the extended agitation time period by a predetermined extension time. The predetermined extension time may be a fixed amount of time. As one example, the predetermined extension time may be set as one hundred eighty (180) seconds, or three (3) minutes. In this way, as will be explained at (230), controller 156 may control agitation element 132 to continue to agitate the load within basket 112 for the predetermined extension time in an attempt to more evenly distribute the load prior to the spin cycle. After increasing the agitation time of the articles within the tub by the predetermined extension time, the method (200) proceeds to (228).

At (228), the method (200) includes adding an attempt to the attempt count. For instance, controller 156 may add one (1) attempt to the attempt count. Thus, each time additional time is added to the agitation phase of the wash cycle in an attempt to more evenly distribute the articles within basket 112 prior to the spin cycle, controller 156 adds a count to the attempt count. In this manner, washing machine appliance 100 does not make an infinite amount of attempts to more evenly distribute the load within basket 112 prior to the spin cycle. For instance, as noted above, if the attempt count is above an attempt limit as determined at (214), then the method (200) proceeds to (216) and washing machine appliance 100 terminates the agitation phase and/or alters one or more characteristics of the wash cycle to attempt to resolve the load distribution in an alternative manner.

At (230), the method (200) includes agitating articles within the tub for an extended agitation time period. For instance, the extended agitation time period may be the determined time remaining if the time remaining determined at (218) is less than the second time remaining threshold as determined at (222). The extended agitation time period may be the predetermined extension time (e.g., 180 seconds) if the time remaining determined at (218) is not less than the second time remaining threshold as determined at (222). Controller 156 may control agitation element 132 to agitate the articles within wash chamber 114 of basket 112 for the extended agitation time period. Further, as shown in FIG. 6, the method (200) returns to (206) and movement of tub 108 (e.g. displacement amplitudes) are measured during the extended agitation time period. As noted above, method (200) may be repeated as many times as the attempt limit allows.

Advantageous and benefits may be realized with implementation of method (200). Notably, method (200) provides a control scheme for washing machine appliance 100 to mitigate or prevent out-of-balance loads from entering a high speed spin cycle. Particularly, during the wash cycle, the movement of the tub 108 is monitored during the agitation phase, e.g., by a measurement device 172, such as an accelerometer and gyroscope. The trend of the tub motion with respect to time is utilized to determine whether further agitation is necessary to more evenly distribute the load prior to the spin cycle. Additional agitation time can be scheduled by controller 156 so that washing machine appliance 100 may attempt more evenly distribute the load prior to the spin cycle. With loads more evenly distributed prior to the spin cycle, issues associated with operating an at high speeds with an out-of-balance load during a spin cycle may be avoided. Specifically, undesirable vibrations and noise emanating from washing machine appliance 100 may be reduced and the probability of tub contact may also be reduced. Other advantages and benefits not specifically listed may also be achieved or realized.

Figure 8:
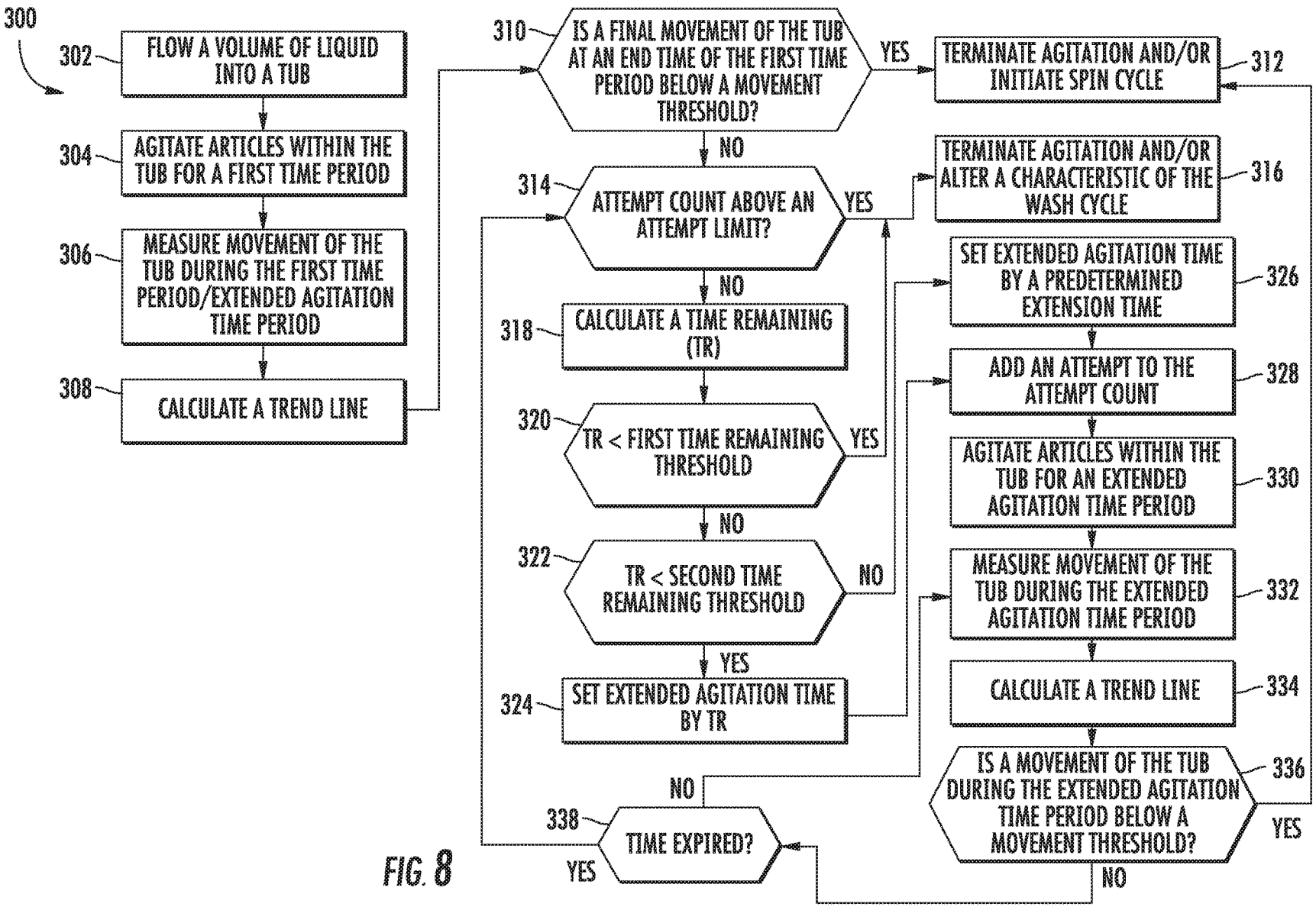
FIG. 8 provides a flow diagram of another exemplary method for operating a washing machine appliance according to example embodiments of the present subject matter.

FIG. 8 provides a flow diagram of an exemplary method (300) for operating a washing machine appliance. For instance, the exemplary method (300) may be utilized to operate the washing machine appliance 100 and components thereof of FIGS. 1 through 5. Accordingly, the method (300) will be described below in the context of operating washing machine appliance 100. However, it will be appreciated that the exemplary method (300) is applicable to operation of a variety of other washing machine appliances, such as horizontal axis washing machine appliances. Further, it should be appreciated that variations and modifications to method (300) are possible and within the scope of the present subject matter. Further, (302), (304), (306), (308), (310), (312), (314), (316), (318), (320), (322), (324), (326), and (328) of method (300) are performed in the same or similar manner as (202), (204), (206), (208), (210), (212), (214), (216), (218), (220), (222), (224), (226), and (228) of method (200) described above, respectively, and accordingly, these parts of method (300) will not be described in detail below for the sake of brevity.

At (332), the method (300) includes measuring movement of the tub during the extended agitation time period. The movement of the tub may be measured as described above at (204) of method (200). The extended agitation time period may be the time remaining if the time remaining determined at (318) is less than the second time remaining threshold as determined at (322). The extended agitation time period may be the predetermined extension time (e.g., 180 seconds) if the time remaining determined at (318) is not less than the second time remaining threshold as determined at (322). The movement measurements may be plotted in a similar manner as shown in FIG. 7. The plurality of data points representative of the movement of tub over the extended agitation time period may be stored in memory device 156C of controller 156.

At (334), the method (300) includes calculating a trend line based at least in part on movement of the tub during the extended agitation time period. The trend line may be calculated at (334) in the same manner as described above at (208) of method (200). The trend line at (334) is calculated based at least in part on the plurality of data points measured at (332). The new trend line may be used, e.g., to calculate the time remaining at (318) if the method (300) returns to (314) as shown in FIG. 8 and described below.

At (336), the method (300) includes determining whether a movement of the tub during the extended agitation time period is below a movement threshold. For instance, controller 156 may continuously compare the movement (e.g., the displacement amplitude) of tub 108 to the movement threshold during the extended agitation time period. The movement threshold may be set to any suitable value, e.g., a displacement amplitude of 0.2 inches. If the movement of the tub during the extended agitation time period is below the movement threshold as determined at (336), the method (300) proceeds to (312). At (312), just like (212) of method (200), the method (300) includes terminating agitation of the articles within the wash chamber and/or initiating a spin cycle. If the movement of the tub during the extended agitation time period is not below the movement threshold as determined at (336), the method (300) proceeds to (338).

At (338), the method (300) includes determining whether the extended agitation time period has expired or elapsed. If the extended agitation time period has not expired as determined at (338), the method (300) proceeds to (332) where measurement device 172 continues to measure the movement of the tub during the extended agitation time period and the method (300) continues until it returns to (338). If the extended agitation time period has indeed expired as determined at (338), the method (300) proceeds to (314) where it is determined whether the attempt count is above the attempt limit.

In implementing method (300), the tub motion or movement continues to be monitored, and if the tub movement falls below the movement threshold during the extended agitation time period, the method (300) may immediately proceed to (312) to terminate agitation of the articles and/or initiate the spin cycle. Accordingly, method (300) provides a means to shorten the extended agitation phase and immediately initiate the spin cycle in the event the load becomes evenly distributed during the extended agitation time period. This may, for example, conserve energy and shorten the overall cycle, among other benefits.

Figure 9:
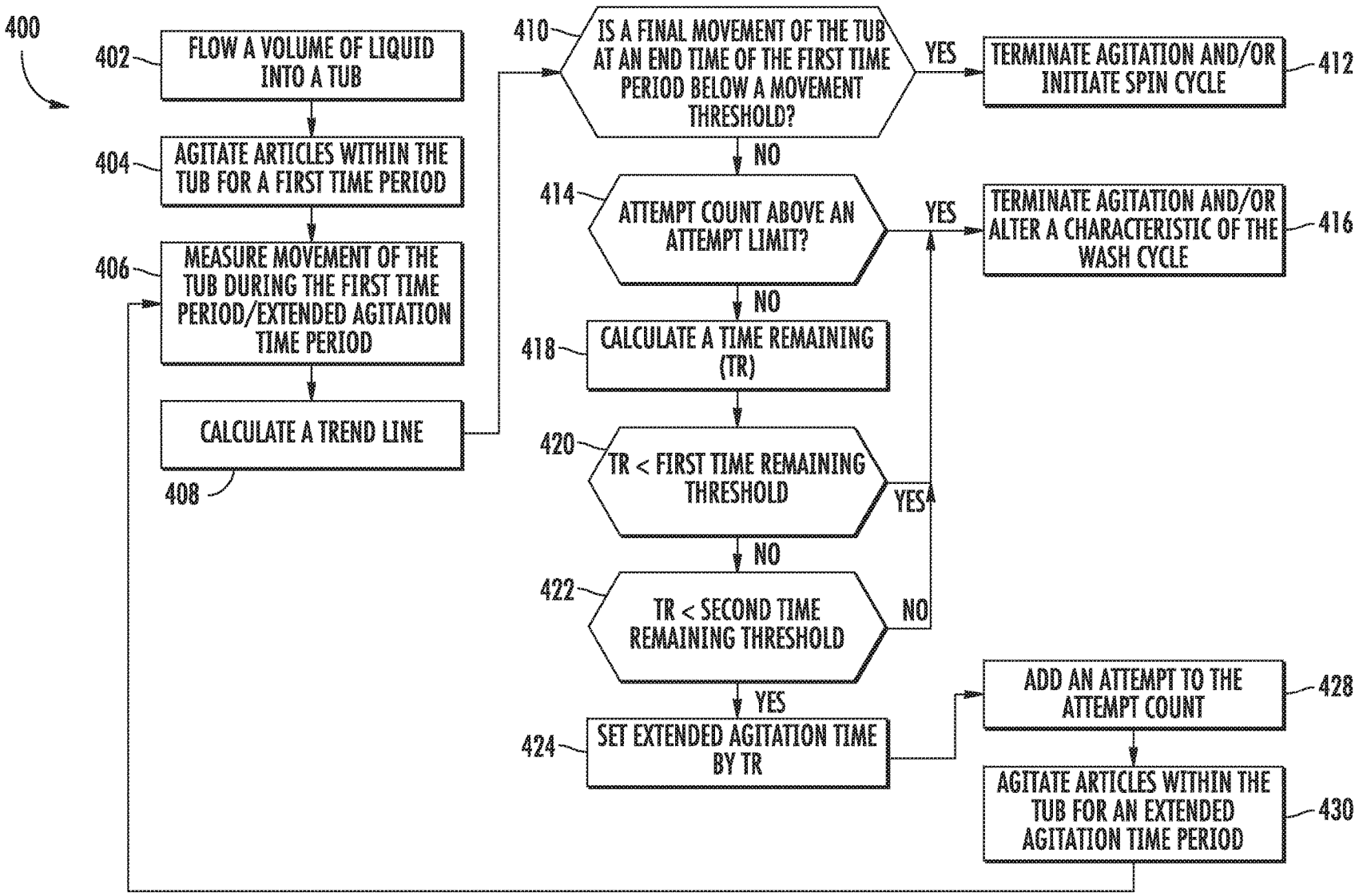
FIG. 9 provides a flow diagram of yet another exemplary method for operating a washing machine appliance according to example embodiments of the present subject matter.

FIG. 9 provides a flow diagram of yet another exemplary method (400) for operating a washing machine appliance. For instance, the exemplary method (400) may be utilized to operate the washing machine appliance 100 and components thereof of FIGS. 1 through 5. Accordingly, the method (400) will be described below in the context of operating washing machine appliance 100. However, it will be appreciated that the exemplary method (400) is applicable to operation of a variety of other washing machine appliances, such as horizontal axis washing machine appliances. Further, it should be appreciated that variations and modifications to method (400) are possible and within the scope of the present subject matter. Further, (402), (404), (406), (408), (410), (412), (414), (416), (418), (420), (422), (424), and (428) of method (400) are performed in the same or similar manner as (202), (204), (206), (208), (210), (212), (214), (216), (218), (220), (222), (224), and (228) of method (200) described above, respectively, and accordingly, these parts of method (400) will not be described in detail below for the sake of brevity.

At (422), the method (400) includes ascertaining whether the determined time remaining is less than a second time remaining threshold. As noted previously, in some implementations, the second time remaining threshold may be set equal to one hundred eighty (180) seconds (three (3) minutes) by controller 156. If the time remaining calculated at (418) is less than the second time remaining threshold, then the method (400) proceeds to (424) where controller 156 sets the time for the extended agitation time period by the determined time remaining, e.g., to better evenly distribute the load within basket 112 prior to the spin cycle. Thus, if the time remaining is less than the second time remaining threshold, method (400) proceeds in the same way that method (200) proceeds to (224). If, however, the time remaining is not less than the second time remaining threshold as determined at (422) (i.e., the time remaining is equal to or greater than the second time remaining threshold), then the method (400) proceeds to (416).

At (416), the method (400) includes terminating agitation of the articles within the wash chamber and/or altering a characteristic of the wash cycle. Accordingly, for this implementation, instead of increasing the agitation time of the extended agitation time period (as done at (226) of method (200) as depicted in FIG. 6), the method (400) proceeds directly with terminating agitation of the articles within the wash chamber and/or altering a characteristic of the wash cycle. Terminating agitation of the articles within the wash chamber may be accomplished as described above at (212). Controller 156 of washing machine appliance 100 may control washing machine appliance 100 to alter one or more characteristics of the ongoing phase of the wash cycle (e.g., rotational speed, acceleration, etc.) as described above at (212). Particularly, the rotational speed of basket 112 may be reduced or the agitation stroke of agitation element 132 may be reduced in an attempt to more evenly distribute the load within basket 112.

In implementing method (400), if the time remaining is not less than the second time remaining threshold as determined at (422), the method (400) may immediately proceed to (416) to terminate agitation of the articles and/or alter a characteristic of the wash cycle. In such implementations, for example, the second time remaining threshold may be set at value in which it would be futile to attempt to redistribute the load within basket 112. In such an example, the method (400) may immediately proceed to (416) so that washing machine appliance 100 can use some other means besides agitation to attempt to redistribute the load. Accordingly, method (400) provides a means to eliminate futile attempts to redistribute the load via extended agitation. This may, for example, conserve energy and shorten the overall cycle, among other benefits.

Figure 10:
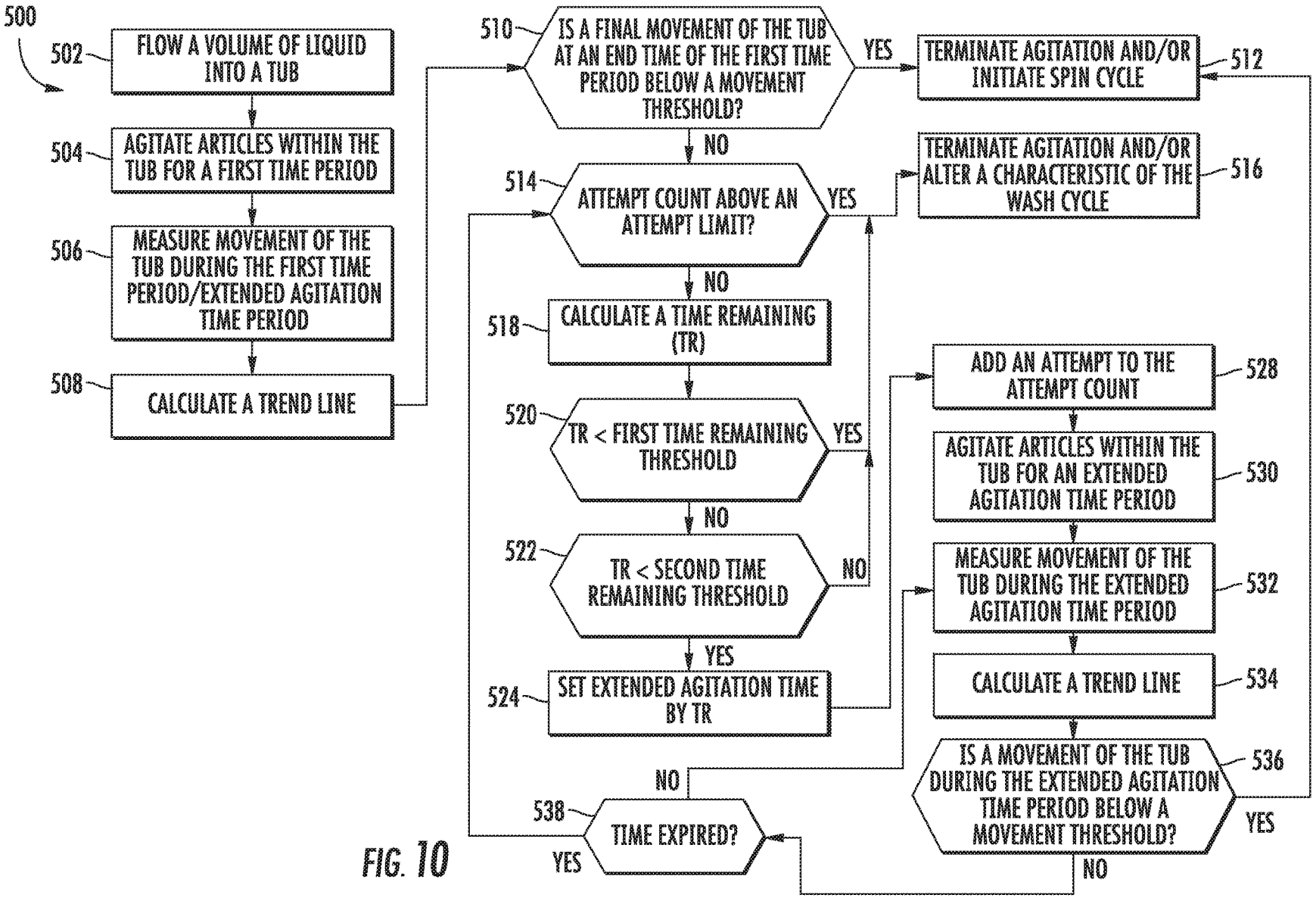
FIG. 10 provides a flow diagram of another exemplary method for operating a washing machine appliance according to example embodiments of the present subject matter.

FIG. 10 provides a flow diagram of another exemplary method (500) for operating a washing machine appliance. For instance, the exemplary method (500) may be utilized to operate the washing machine appliance 100 and components thereof of FIGS. 1 through 5. Accordingly, the method (500) will be described below in the context of operating washing machine appliance 100. However, it will be appreciated that the exemplary method (500) is applicable to operation of a variety of other washing machine appliances, such as horizontal axis washing machine appliances. Further, it should be appreciated that variations and modifications to method (500) are possible and within the scope of the present subject matter. Further, (502), (505), (506), (508), (510), (512), (514), (516), (518), (520), (522), (524), and (528) of method (500) are performed in the same or similar manner as (202), (204), (206), (208), (210), (212), (214), (216), (218), (220), (222), (224), and (228) of method (200) described above, respectively, and accordingly, these parts of method (500) will not be described in detail below for the sake of brevity. Generally, method (500) is a combination of features of methods (300) and (400) of FIGS. 8 and 9, respectively.

At (522), the method (500) includes ascertaining whether the determined time remaining is less than a second time remaining threshold. As noted previously, in some implementations, the second time remaining threshold may be set equal to one hundred eighty (180) seconds (three (3) minutes) by controller 156 or any other suitable value. If the time remaining calculated at (518) is less than the second time remaining threshold, then the method (500) proceeds to (524) where controller 156 sets the time for the extended agitation time period by the determined time remaining, e.g., to better evenly distribute the load within basket 112 prior to the spin cycle. Thus, if the time remaining is less than the second time remaining threshold, method (500) proceeds in the same way that method (200) proceeds to (224) and that method (400) proceeds to (424). If, however, the time remaining is not less than the second time remaining threshold as determined at (522) (i.e., the time remaining is equal to or greater than the second time remaining threshold), then the method (500) proceeds to (516).

At (516), the method (500) includes terminating agitation of the articles within the wash chamber and/or altering a characteristic of the wash cycle. Accordingly, for this implementation, instead of increasing the agitation time of the extended agitation time period (as done at (226) of method (200) as depicted in FIG. 6), the method (500) proceeds directly with terminating agitation of the articles within the wash chamber and/or altering a characteristic of the wash cycle. Terminating agitation of the articles within the wash chamber may be accomplished as described above at (212). Controller 156 of washing machine appliance 100 may control washing machine appliance 100 to alter one or more characteristics of the ongoing phase of the wash cycle (e.g., rotational speed, acceleration, etc.) as described above at (212). Particularly, the rotational speed of basket 112 may be reduced or the agitation stroke of agitation element 132 may be reduced in an attempt to more evenly distribute the load within basket 112.

At (532), the method (500) includes measuring movement of the tub during the extended agitation time period. The movement of the tub may be measured as described above at (204) of method (200). The extended agitation time period may be the time remaining if the time remaining determined at (518) is less than the second time remaining threshold as determined at (522). The extended agitation time period may be the predetermined extension time (e.g., 180 seconds) if the time remaining determined at (518) is not less than the second time remaining threshold as determined at (522). The movement measurements may be plotted in a similar manner as shown in FIG. 7. The plurality of data points representative of the movement of tub over the extended agitation time period may be stored in memory device 156C of controller 156.

At (534), the method (500) includes calculating a trend line based at least in part on movement of the tub during the extended agitation time period. The trend line may be calculated at (534) in the same manner as described above at (208) of method (200). The trend line at (534) is calculated based at least in part on the plurality of data points measured at (532). The new trend line may be used, e.g., to calculate the time remaining at (518) if the method (500) returns to (514) as shown in FIG. 10 and described below.

At (536), the method (500) includes determining whether a movement of the tub during the extended agitation time period is below a movement threshold. For instance, controller 156 may continuously compare the movement (e.g., the displacement amplitude) of tub 108 to the movement threshold during the extended agitation time period. The movement threshold may be set to any suitable value, e.g., a displacement amplitude of 0.2 inches. If the movement of the tub during the extended agitation time period is below the movement threshold as determined at (536), the method (500) proceeds to (512). At (512), just like (212) of method (200), the method (500) includes terminating agitation of the articles within the wash chamber and/or initiating a spin cycle. If the movement of the tub during the extended agitation time period is not below the movement threshold as determined at (536), the method (500) proceeds to (538).

At (538), the method (500) includes determining whether the extended agitation time period has expired or elapsed. If the extended agitation time period has not expired as determined at (538), the method (500) proceeds to (532) where measurement device 172 continues to measure the movement of the tub during the extended agitation time period and the method (500) continues until it returns to (538). If the extended agitation time period has indeed expired as determined at (538), the method (500) proceeds to (514) where it is determined whether the attempt count is above the attempt limit.

In implementing method (500), the benefits described above with respect to method (300) and method (400) may be realized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the method comprising:

flowing a volume of liquid into a tub of the washing machine appliance;

agitating articles within a basket rotatably mounted within the tub for a first time period;

measuring movement of the tub during the first time period;

calculating a trend line based at least in part on movement of the tub during the first time period;

determining an agitation time remaining based at least in part on the trend line, the agitation time remaining indicating a remaining time in which articles within the basket are to be agitated;

ascertaining whether the agitation time remaining is less than a time remaining threshold; and agitating articles within the basket for an extended agitation time period based at least in part on whether the determined agitation time remaining is less than the time remaining threshold.

2. The method of claim 1, wherein measuring movement of the tub during the first time period comprises measuring a displacement amplitude of the tub over the first time period using a measurement device.

3. The method of claim 2, wherein the trend line specifies the displacement amplitude of the tub versus time.

4. The method of claim 1, further comprising:

storing a plurality of data points representative of movement of the tub during the first time period, wherein the trend line is calculated based at least in part on the stored plurality of data points.

5. The method of claim 1, wherein determining the agitation time remaining based at least in part on the trend line comprises:

calculating a predicted time utilizing the trend line, wherein the predicted time is predictive of a time in which movement of the tub is equal to a preselected movement target; and subtracting a current time from the determined predicted time.

6. The method of claim 1, wherein the time remaining threshold is a first time remaining threshold, and wherein the method further comprises:

ascertaining, when the agitation time remaining is less than the first time remaining threshold, whether the agitation time remaining is less than a second time remaining threshold.

7. The method of claim 6, wherein, in ascertaining whether the agitation time remaining is less than the second time remaining threshold:

i) when the agitation time remaining is less than the second time remaining threshold, the method further comprises setting the extended agitation time period by the determined agitation time remaining; and ii) when the agitation time remaining is not less than the second time remaining threshold, the method further comprises setting the extended agitation time period by a predetermined extension time.

8. The method of claim 6, wherein, in ascertaining whether the agitation time remaining is less than the second time remaining threshold, when the agitation time remaining is not less than the second time remaining threshold, the method further comprises:

performing at least one of: i) terminating agitation; and ii) altering a characteristic of the washing machine appliance.

9. The method of claim 6, wherein when the agitation time remaining is greater than the first time remaining threshold, the method further comprises:

adding an attempt to an attempt count.

10. The method of claim 6, wherein when the determined agitation time remaining is greater than the first time remaining threshold and less than the second time remaining threshold, articles within the basket are agitated for the extended agitation time period, and wherein the method further comprises:

measuring movement of the tub during the extended agitation time period;

determining whether a movement of the tub during the extended agitation time period is below a movement threshold; and performing, when the movement of the tub during the extended agitation time period is below the movement threshold, at least one of: i) terminating agitation; and ii) initiating a spin cycle of the washing machine appliance.

11. The method of claim 1, wherein prior to determining the agitation time remaining based at least in part on the trend line, the method further comprises:

determining whether a final movement of the tub at an end time of the first time period is below a movement threshold.

12. The method of claim 11, wherein when the final movement is below the movement threshold, the method further comprises:

performing at least one of: i) terminating agitation; and ii) initiating a spin cycle of the washing machine appliance.

13. The method of claim 11, wherein when the final movement is not below the movement threshold, the method further comprises:

determining whether an attempt count is above an attempt limit.

14. The method of claim 13, wherein when the attempt count is above the attempt limit, the method further comprises:

performing at least one of: i) terminating agitation; ii) altering a characteristic of the washing machine appliance, wherein altering the characteristic of the washing machine appliances comprises altering a rotational speed or acceleration of the basket; and iii) adding a volume of water into the tub.

15. A washing machine appliance, comprising:

a tub positioned within a cabinet;

a basket rotatably mounted within the tub, the basket defining a wash chamber for receipt of articles for washing;

an agitation element positioned in the basket;

a motor in mechanical communication with the basket and the agitation element, the motor being configured for selectively rotating the basket and the agitation element within the tub;

a measurement device mounted to the tub, the measurement device having at least one of an accelerometer and a gyroscope;

a water control valve for regulating a flow of water from a water supply source into the tub; and a controller communicatively coupled with the motor, the measurement device, and the water control valve, the controller configured to:

regulate the water control valve to flow a volume of water into the tub;

operate the motor to rotate the agitation element for a first time period;

receive, from the measurement device, movement measurements of the tub during the first time period;

calculate a trend line based at least in part on movement measurements of the tub during the first time period;

determine an agitation time remaining based at least in part on the trend line, the agitation time remaining indicating a remaining time in which articles within the basket are to be agitated;

ascertain whether the determined agitation time remaining is greater than a first time remaining threshold;

ascertain whether the determined agitation time remaining is less than a second time remaining threshold; and operate the motor to rotate the agitation element for an extended agitation time period based at least in part on whether the determined agitation time remaining is greater than the first time remaining threshold and less than the second time remaining threshold.

16. The washing machine appliance of claim 15, wherein when the determined agitation time remaining is greater than the first time remaining threshold and the second time remaining threshold, the controller operates the motor to rotate the agitation element for the extended agitation time period, and wherein when the determined agitation time remaining is less than the first time remaining threshold, the controller is configured to initiate a spin cycle.

17. The washing machine appliance of claim 16, wherein in initiating the spin cycle, the controller is configured to:

activate a drain pump assembly to drain liquid from the tub; and operate the motor to rotate the basket.

18. The washing machine appliance of claim 15, wherein the trend line is calculated utilizing a linear regression technique.

19. The washing machine appliance of claim 15, wherein the measurement device comprises both the accelerometer and the gyroscope.

20. A method for operating a washing machine appliance, the method comprising:

flowing a volume of liquid into a tub of the washing machine appliance;

agitating articles within a basket rotatably mounted within the tub for a first time period;

measuring movement of the tub during the first time period;

calculating a trend line based at least in part on movement of the tub during the first time period;

determining an agitation time remaining based at least in part on the trend line, the agitation time remaining indicating a remaining time in which articles within the basket are to be agitated;

ascertaining whether the agitation time remaining is less than a time remaining threshold; and agitating articles within the basket for an extended agitation time period based at least in part on whether the determined agitation time remaining is less than the time remaining threshold, and wherein:

i) when the agitation time remaining is less than the time remaining threshold, the extended agitation time period is set as the determined agitation time remaining, and ii) when the agitation time remaining is not less than the time remaining threshold, the extended agitation time period is set as a predetermined extension time.

* * * * *